US006413010B2

(12) United States Patent
Coleman

(10) Patent No.: US 6,413,010 B2
(45) Date of Patent: Jul. 2, 2002

(54) TRAFFIC DIRECTIONAL MAT

(76) Inventor: Max F. Coleman, 275 Ulumalu Rd., Haiku, HI (US) 96708

( * ) Notice: Subject to any disclaimer, the term of this patent is extended or adjusted under 35 U.S.C. 154(b) by 0 days.

(21) Appl. No.: 09/919,754

(22) Filed: Aug. 1, 2001

Related U.S. Application Data

(62) Division of application No. 09/477,004, filed on Jan. 3, 2000, now abandoned.

(51) Int. Cl.[7] ..... E01F 9/00
(52) U.S. Cl. ..... 404/14; 116/63 P
(58) Field of Search ..... 404/1, 6, 9, 12, 404/14, 18, 32, 35, 42; 116/63 P, 63 R; D12/203

(56) References Cited

U.S. PATENT DOCUMENTS

| | | | | |
|---|---|---|---|---|
| 1,732,869 A | | 10/1929 | Wambach | |
| 2,438,764 A | | 3/1948 | Phillips | 94/1.5 |
| 3,334,554 A | | 8/1967 | Adams | 94/1.5 |
| 4,687,369 A | | 8/1987 | McDonald | 404/12 |
| 4,818,138 A | | 4/1989 | Brown | 404/14 |
| 4,875,799 A | * | 10/1989 | Harrison | 404/12 |
| 5,242,242 A | | 9/1993 | Young | 404/12 |
| 5,439,171 A | | 8/1995 | Fruend | 238/14 |
| 5,769,563 A | | 6/1998 | Flynn | 404/15 |
| 5,775,834 A | | 7/1998 | Jackson | 404/15 |
| 5,980,664 A | * | 11/1999 | Wilson, Sr. | 156/71 |
| 6,045,294 A | | 4/2000 | Hansen | 404/14 |

* cited by examiner

*Primary Examiner*—H. Shackelford
*Assistant Examiner*—Gary S. Hartmann
(74) *Attorney, Agent, or Firm*—Michael I. Kroll

(57) ABSTRACT

The present invention discloses a traffic directional mat 10 which is expected to be made of black, rubber-like material. The mat 10 is a relatively thin, generally rectangular body which is designed to be placed on a roadway in a pre-selected pattern or line in order to indicate the direction of travel for the traffic. The mat has an indented 20 arrow 18, which arrow may be painted in reflective paint 32 so as to be clearly visible to the driver 34 of a vehicle 24. The mats 10 are expected to be about 4'×5' being about ⅝ inch thick having a 3'×4' arrow with about a ¼ inch indention. The mat is stored in the trunk of a police vehicle and placed on a roadway to re-direct traffic.

2 Claims, 11 Drawing Sheets

TRAFFIC DIRECTIONAL MAT

This application is a divisional of Ser. No. 09/477,004, filed Jan. 3, 2000, now abandoned.

BACKGROUND OF THE INVENTION

1. Field of the Invention

The present invention relates generally to traffic control devices and, more specifically, to traffic direction control devices. The preferred embodiment of the present invention, the Traffic Directional Mat, is a 4'×5'×⅝" black rubber mat with a ¼" indented 3'×4' arrow painted with white reflective paint. It is designed to be placed on the roadway concatenated in large numbers in the lane of travel to provide a clear path indicating the direction the traffic is to follow. These mats can be used either independently or in conjunction with traffic safety cones to provide clearer traffic direction information to the motorist of all cultural and educational backgrounds. The problem with using a multiplicity of traffic cones as the sole traffic direction control method is that they don't always indicate clearly the correct path for the redirection of traffic. This is due, in part, to the often less-then-perfect ambient light conditions as well as to the nature of the device itself which presents an obstacle to travel rather than a directional indication. Using traffic cones in conjunction with Directional Mats, however, gives the motorist a complete traffic direction information picture, with the mats clearly indicating the path and the cones indicating the lateral boundaries of the path. The internationally recognized arrow symbol is also easily understood by motorist of all backgrounds. The Traffic Directional Mat is durable, easy to clean, portable and easy to maintain (the indented arrow can be repainted with reflective paint).

It increases highway safety and lowers liability exposure which makes the Directional Mat a perfect compliment to any traffic control inventory.

2. Description of the Prior Art

There are other traffic controls devices designed for controlling the flow of traffic. Typical of these is U.S. Pat. No. 5,397,617 issued to Judy Chen on Mar. 14, 1995.

Another patent was issued to Peter Hedgewick on Oct. 29, 1991 as U.S. Pat. No. 5,061,114. Yet another U.S. Pat. No. 3,768,383 was issued to Hartwell F. Tucker on Oct. 30, 1973 and still yet another was issued on Mar. 30, 1948 to W. A. Phillips as U.S. Pat. No. 2,438,764.

Another patent was issued to W. S Rockwell on Dec. 29, 1936 as U.S. Pat. No. 2,065,872. Yet another U.S. Pat. No. 1,581,809 was issued to J. R. O'Brien on Apr. 20, 1926.

U.S. Pat. No. 5,397,617

Inventor: Judy Chen

Issued: Mar. 14, 1995

A reflective road sign made of a transparent tempered glass consisted of a cylindrical base, and a dome connected above the cylindrical base, the cylindrical base having a peripheral outside wall coated with an inner layer of light-permeable color covering, an outer layer of corrosion resisting coating, and an intermediate layer of reflective metal coating between the inner layer of light permeable color covering and the outer layer of corrosion resisting coating.

U.S. Pat. No. 5,061,114

Inventor: Peter Hedgewick

Issued: Oct. 29, 1991

A reflective pavement marker of the type having a shell-like housing of synthetic resin or other moldable material with a reflective end wall of light transmitting material with a filler of epoxy or other potting material. The reflective end wall is formed with retro-directive reflective elements of cube corner type. The end wall is dished so that light rays reflect from the array of cube corner reflective elements and converge to enhance the candlepower of the reflective light. Also disclosed is a method and apparatus for making the device.

U.S. Pat. No. 3,768,383

Inventor: Hartwell F. Tucker

Issued: Oct. 30, 1973

An automobile driving lane or roadbed marker device for attachment to a roadbed has a configuration which indicates to the driver of the automobile the proper direction of movement in a traffic lane, while defining the boundaries of the traffic lane. The marker device has a low-profile elongated three-dimensional body the bottom surface of which is flat and which tapers in width from about 4 to 8 inches at one end to one to 2 inches at the other end. The top surface of the body is divided into facets or angularly disposed surfaces which themselves reflect light, or on which separate reflective units are formed or attached.

U.S. Pat. No. 2,438,764

Inventor: W. A. Phillips

Issued: Mar. 30, 1948

In a device for use in applying a traffic control marking to the soft upper surface of a highway, a carrier composed of a compressible material provided with a series of spaced openings extending entirely through the carrier and arranged to depict the desired traffic control marking, and individual hard element in and substantially filling each of said carrier openings, and a frangible sheet closing the ends of said openings for retaining said elements therein.

U.S. Pat. No. 2,065,872

Inventor: Walter S. Rockwell

Issued: Dec. 29, 1936

A sign including a flexible open mesh backing adapted to be embedded in self-hardening plastic material, the interstices of the backing being of a size as to permit the plastic material to pass therethrough, and wire of rod-like form defining the outline of a symbol secured to said area as to project a sufficient distance from the adjacent face of the backing to provide a form for retaining self-hardening plastic material of a different color than that in which the backing is adapted to be embedded.

U.S. Pat. No. Des. 1,581,809

Inventor: James Raymond O'Brien

Issued: Apr. 20, 1926

A road marker embodying a block like body portion, the upper surface thereof being substantially flat, and an anchor plate upon which the block rests, the lower face of the block and the said plate being secured together, the said plate projecting beyond the block to form flanges continuous throughout the length of the respective adjacent upright surfaces of the block, said block being adapted to be embedded in the pavement so that the pavement will rest upon the said flanges and thereby anchor the block for yielding movement with the pavement, the top of the said block being normally flush with the upper surface of the adjacent portion of the pavement.

While these traffic control devices may be suitable for the purposes for which they were designed, they would not be as suitable for the purposes of the present invention, as hereinafter described.

SUMMARY OF THE PRESENT INVENTION

The present invention discloses a traffic directional mat which is expected to be made of black, rubber-like material. The mat is a relatively thin, generally rectangular body which is designed to be placed on a roadway in a preselected pattern or line in order to indicate the direction of travel for the traffic. The mat has an indented arrow, which arrow may be painted in reflective paint so as to be clearly visible to the driver of a vehicle. The mats are expected to be about 4'×5' being about ⅝ inch thick having a 3'×4' arrow with about a ¼ inch indention.

A primary object of the present invention is to provide an unambiguous traffic directional control device that will be completely understandable to motorists of all backgrounds.

Another object of the present invention is to provide an unambiguous traffic directional control device that will be completely understandable to motorists of all backgrounds and that can be used independently or in conjunction with other devices to enhance the effectiveness of traffic directional control.

Yet another object of the present invention is to provide an unambiguous traffic directional control device that will be completely understandable to motorists of all backgrounds, can be used independently or in conjunction with other devices to enhance the effectiveness of traffic directional control and that is clearly visible under all ambient light conditions.

Still yet another object of the present invention is to provide an unambiguous traffic directional control device that will be completely understandable to motorists of all backgrounds, can be used independently or in conjunction with other devices to enhance the effectiveness of traffic directional control, that is clearly visible under all ambient light conditions and is durable.

Another object of the present invention is to provide an unambiguous traffic directional control device that will be completely understandable to motorists of all backgrounds, can be used independently or in conjunction with other devices to enhance the effectiveness of traffic directional control, that is clearly visible under all ambient light conditions and that is durable and easy to clean.

Yet another object of the present invention is to provide an unambiguous traffic directional control device that will be completely understandable to motorists of all backgrounds, can be used independently or in conjunction with other devices to enhance the effectiveness of traffic directional control, that is clearly visible under all ambient light conditions and that is durable, easy to clean and portable.

Still yet another object of the present invention is to provide an unambiguous traffic directional control device that will be completely understandable to motorists of all backgrounds, can be used independently or in conjunction with other devices to enhance the effectiveness of traffic directional control, that is clearly visible under all ambient light conditions and that is durable, easy to clean, portable and easy to maintain (can be refinished with reflective paint).

Another object of the present invention is to provide an unambiguous traffic directional control device that will be completely understandable to motorists of all backgrounds, can be used independently or in conjunction with other devices to enhance the effectiveness of traffic directional control, that is clearly visible under all ambient light conditions and that is durable, easy to clean, portable, easy to maintain (can be refinished with reflective paint) and that will increase highway safety.

Yet another object of the present invention is to provide an unambiguous traffic directional control device that will be completely understandable to motorists of all backgrounds, can be used independently or in conjunction with other devices to enhance the effectiveness of traffic directional control, that is clearly visible under all ambient light conditions, that is durable, easy to clean, portable, easy to maintain (can be refinished with reflective paint), that will increase highway safety and lower the liability exposure of organizations involved in traffic control.

Additional objects of the present invention will appear as the description proceeds.

The present invention overcomes the shortcomings of the prior art by providing a traffic directional control device, the Traffic Directional Mat, designed to be placed on the roadway concatenated in large numbers in the lane of travel to provide a clear path indicating the direction the traffic is to follow. The preferred embodiment of the present invention, the Traffic Directional Mat, is a 4'×5'×⅝ black rubber mat with a ¼" indented 3'×4' arrow painted with white reflective paint. These mats can be used either independently or in conjunction with traffic safety cones to provide clearer traffic direction information to the motorist of all cultural and educational backgrounds. The problem with using a multiplicity of traffic cones as the sole traffic direction control method is that they don't always indicate clearly the correct path for the redirection of traffic. This is due, in part, to the often less-then-perfect ambient light conditions as well as to the nature of the device itself which presents an obstacle to travel rather than a directional indication. Using traffic cones in conjunction with Directional Mats, however, gives the motorist a complete traffic direction information picture, with the mats clearly indicating the path and the cones indicating the lateral boundaries of the path. The internationally recognized arrow symbol is also easily understood by motorist of all backgrounds. The Traffic Directional Mat is durable, easy to clean, portable and easy to maintain (the indented arrow can be repainted with reflective paint). It increases highway safety and lowers liability exposure which makes the Directional Mat a perfect compliment to any traffic control inventory.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
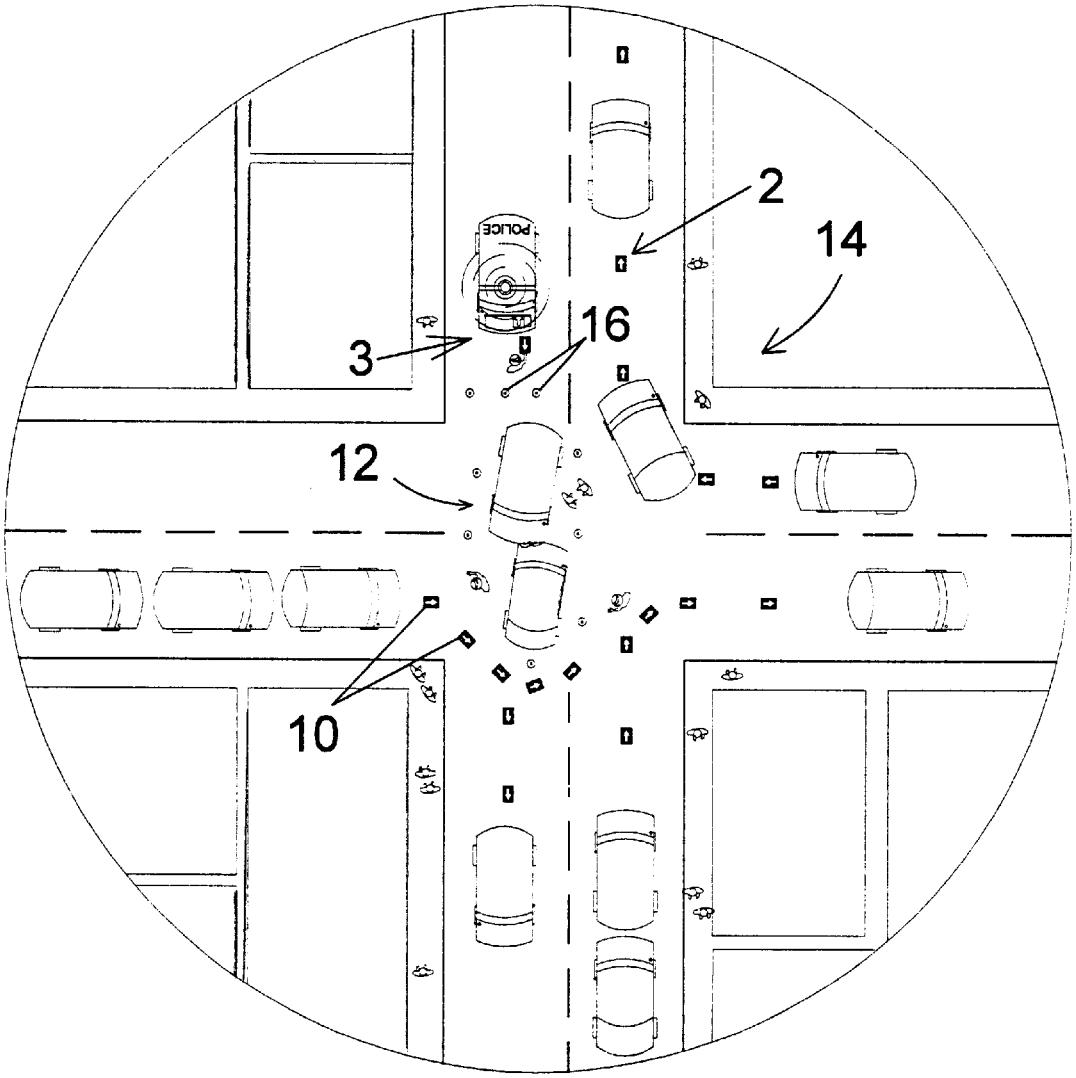
FIG. 1 is a pictorial view looking down, depicting an auto collision obstructing flow of traffic at an intersection. Traffic safety cones are set up at the scene in conjunction with traffic directional mats. The traffic directional mats may be used either independently or in conjunction with other safety devices. The traffic directional mats clearly indicate the correct path of redirected traffic in all ambient light conditions due to its reflective nature.

With regard to reference numerals used, the following numbering is used throughout the drawings.

10 present invention
12 auto collision
14 intersection
16 cone
18 arrow
20 indention
22 trunk
24 vehicle
26 stack of mats
28 emergency vehicle
32 reflective qualities
34 motorist
36 rain

DESCRIPTION OF THE PREFERRED EMBODIMENT(S)

In order that the invention may be more fully understood, it will now be described, by way of example, with reference to the accompanying drawings in which FIGS. 1 through 11 illustrate the present invention being a traffic directional mat.

Turning to FIG. 1, shown therein is a pictorial view looking down, depicting an auto collision 12 obstructing the flow of traffic at an intersection 14. Multiple traffic safety cones 16 are set up at the scene in conjunction with multiple traffic directional mats 10. The traffic directional mats 10 may be used either independently or in conjunction with other safety devices such as cones 16. The traffic directional mats 10 clearly indicate the correct path of redirected traffic in all ambient light conditions due to its reflective nature.

Figure 2:
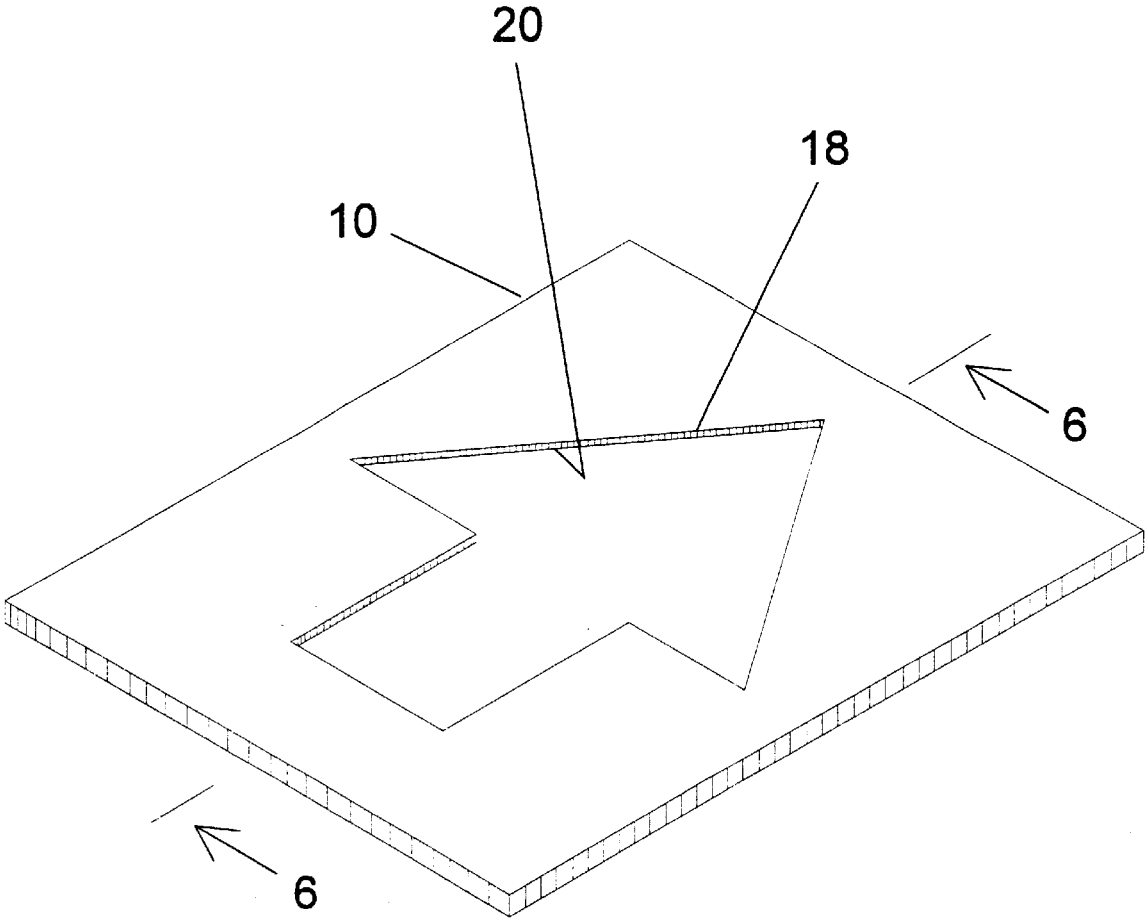
FIG. 2 is a perspective view of the present invention illustrating the indented reflective arrow in proportion to the mat itself The indented arrow may be repainted with reflective paint as required and utilized redundantly.

Turning to FIG. 2, shown therein is a perspective view of the present invention 10 illustrating the indented reflective arrow 18 with indention 20 in proportion to the mat itself. The indented arrow 18 may be repainted with reflective paint as required and utilized redundantly. The planar, generally rectangular nature of mat 10 is also shown.

Figure 3:
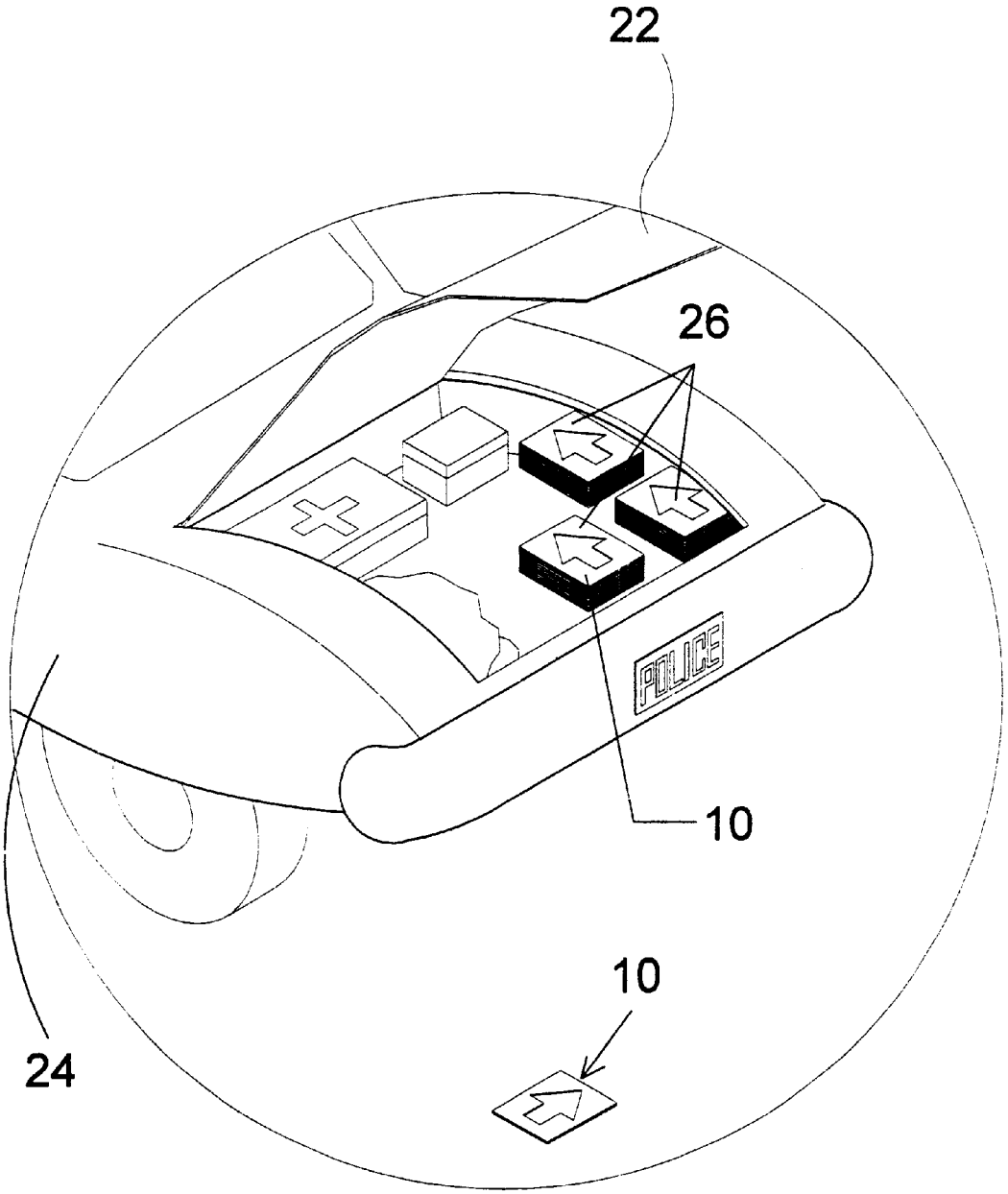
FIG. 3 is a pictorial view depicting the traffic directional mats conveniently stacked in the trunk of a police vehicle. The traffic directional mat may be easily accessed, utilized and restacked as required. The traffic directional mat is durable, easy to clean, portable and easy to maintain and a perfect compliment to highway construction or municipal departments as well as a police traffic safety alternate device in which may be used in conjunction with other safety devices or independently.

Turning to FIG. 3, shown therein is a pictorial view depicting the traffic directional mats 10 conveniently stacked 26 in the trunk 22 of a police vehicle 24. The traffic directional mat 10 may be easily accessed, utilized and restacked as required. The traffic directional mat is durable, easy to clean, portable and easy to maintain and a perfect compliment to highway construction or municipal departments as well as a police traffic safety alternate device which may be used in conjunction with other safety devices or independently.

Figure 4:
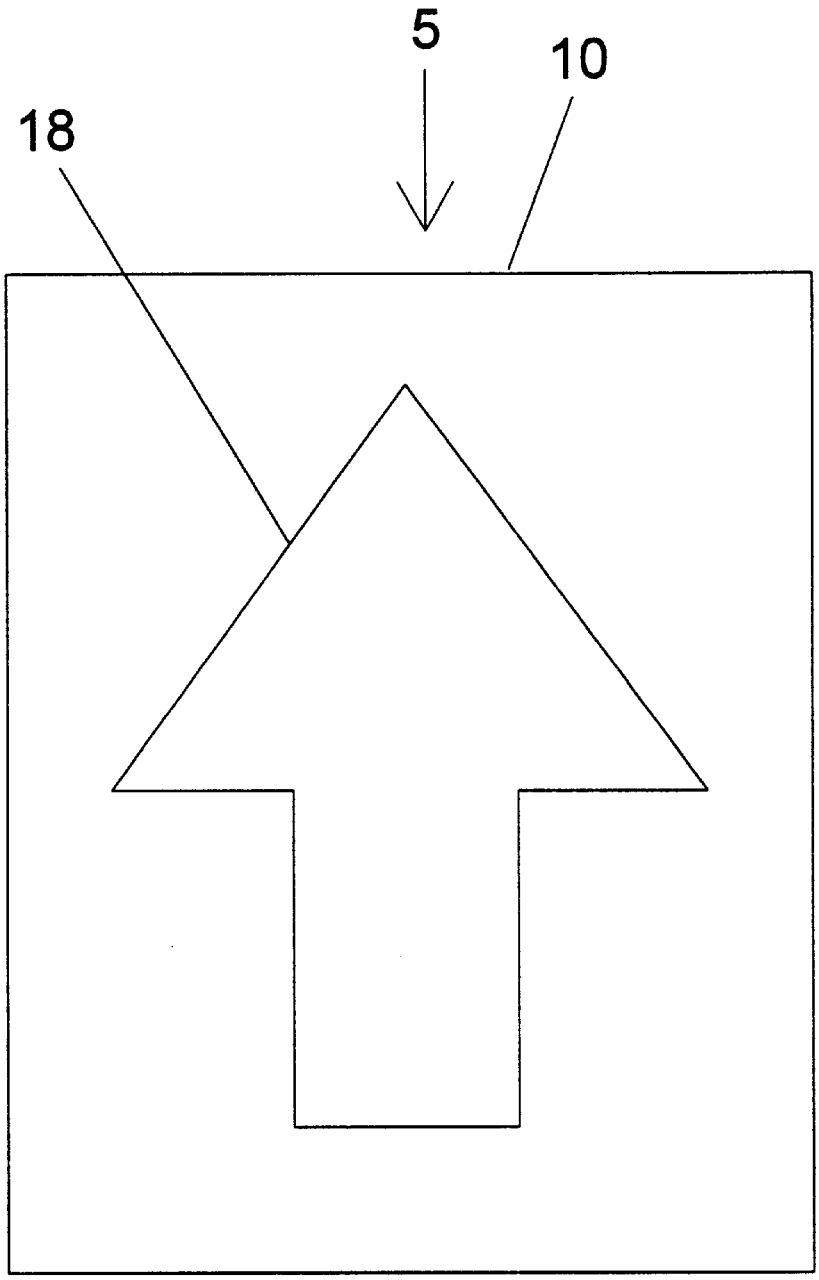
FIG. 4 is a top view of the present invention depicting the indented arrow in proportion to the mat itself. Also indicated, the direction of view of the following FIG. 5.

Turning to FIG. 4, shown therein is a top view of the present invention 10 depicting the indented arrow 18 in proportion to the mat itself. Also indicated is the direction of view of the following FIG. 5.

Figure 5:
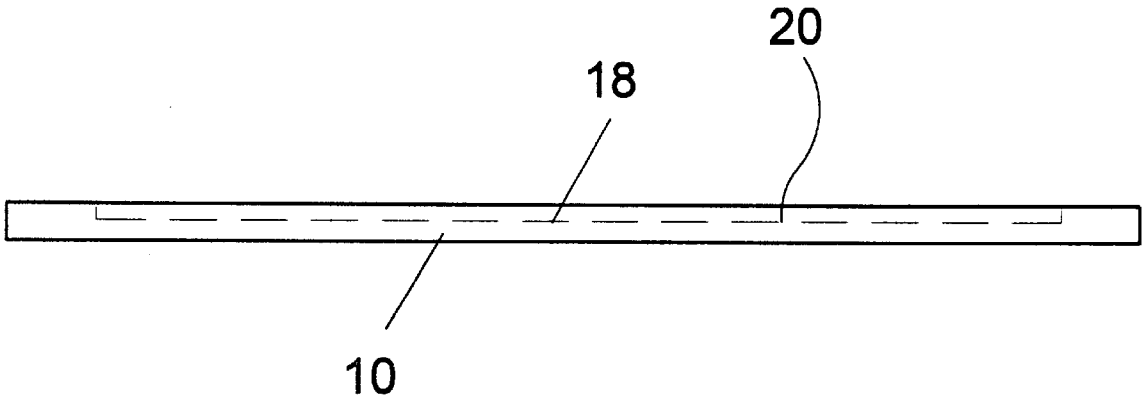
FIG. 5 is a front view of the present invention as per indicated on FIG. 4 with respect to direction of view. Shown in phantom line, the depth of the indented arrow of the present invention.

Turning to FIG. 5, shown therein is a front view of the present invention 10 as indicated on FIG. 4 with respect to direction of view. Shown in phantom line is the depth of the indented arrow 18 with indention 20 of the present invention 10.

Figure 6:
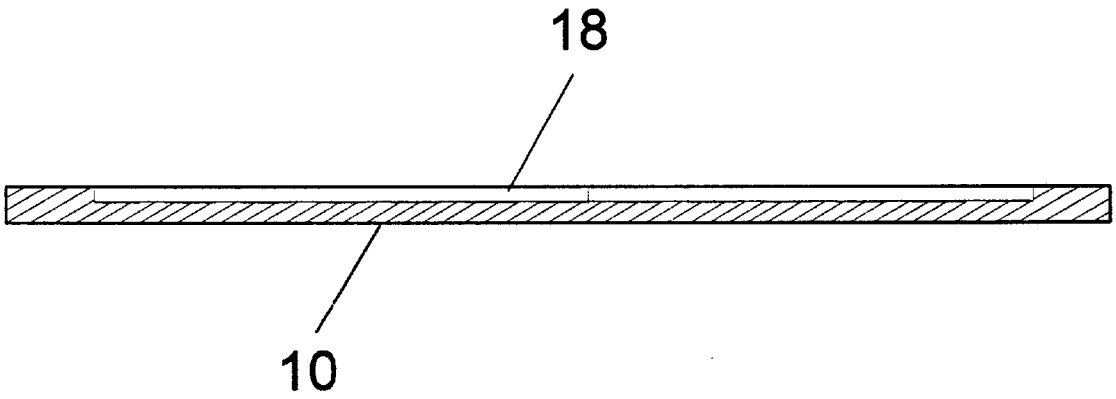
FIG. 6 is a sectional view of the present invention showing the depth of the indented arrow in respect to the proportions of the mat itself.

Turning to FIG. 6, shown therein is a sectional view of the present invention 10 showing the depth of the indented arrow 18 in respect to the proportions of the mat itself.

Figure 7:
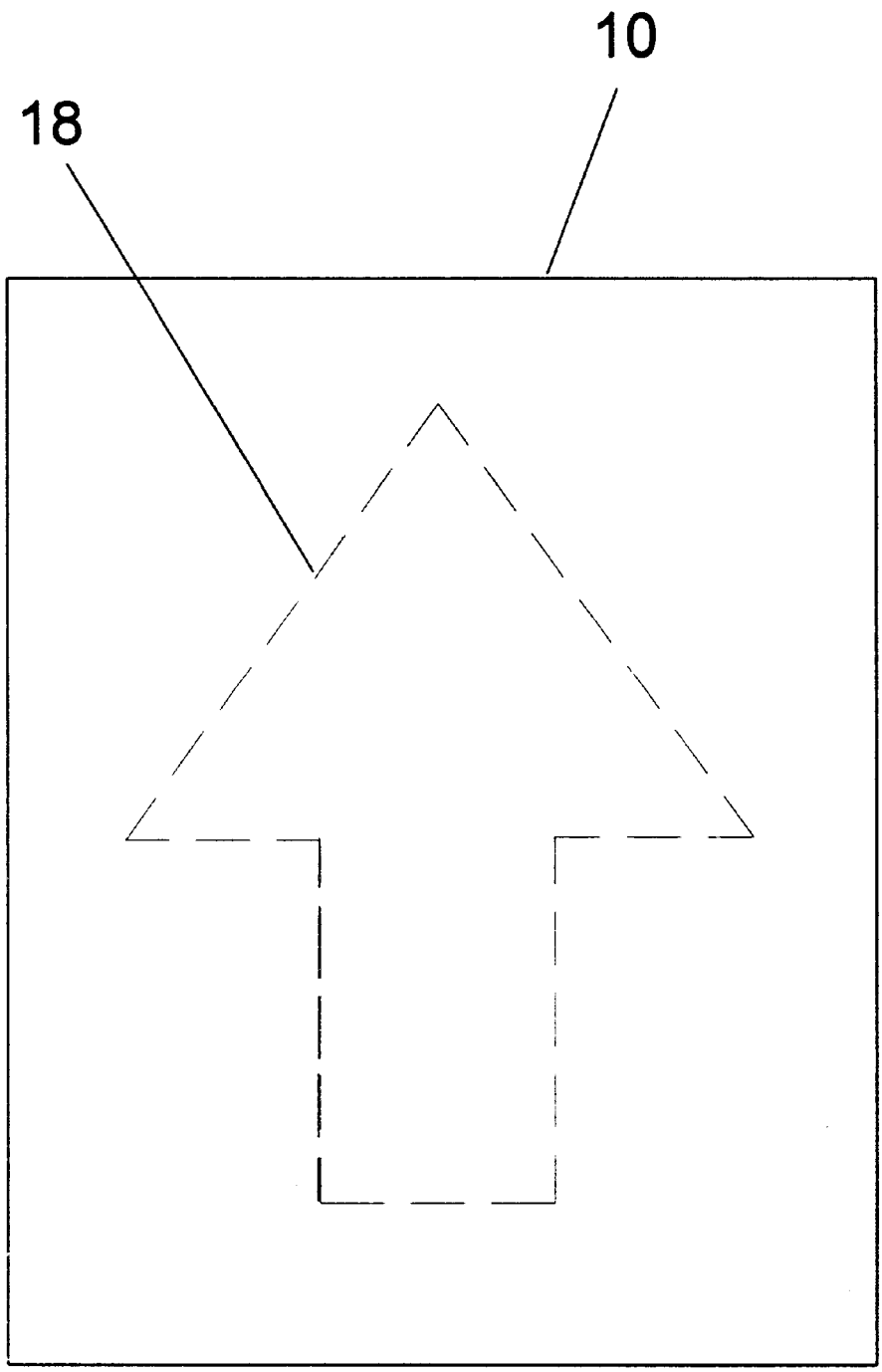
FIG. 7 is a bottom view of the present invention depicting the indented directional arrow in phantom line and in proportion to the size of the mat itself.

Turning to FIG. 7, shown therein is a bottom view of the present invention 10 depicting the indented directional arrow 18 in phantom line and in proportion to the size of the mat itself.

Figure 8:
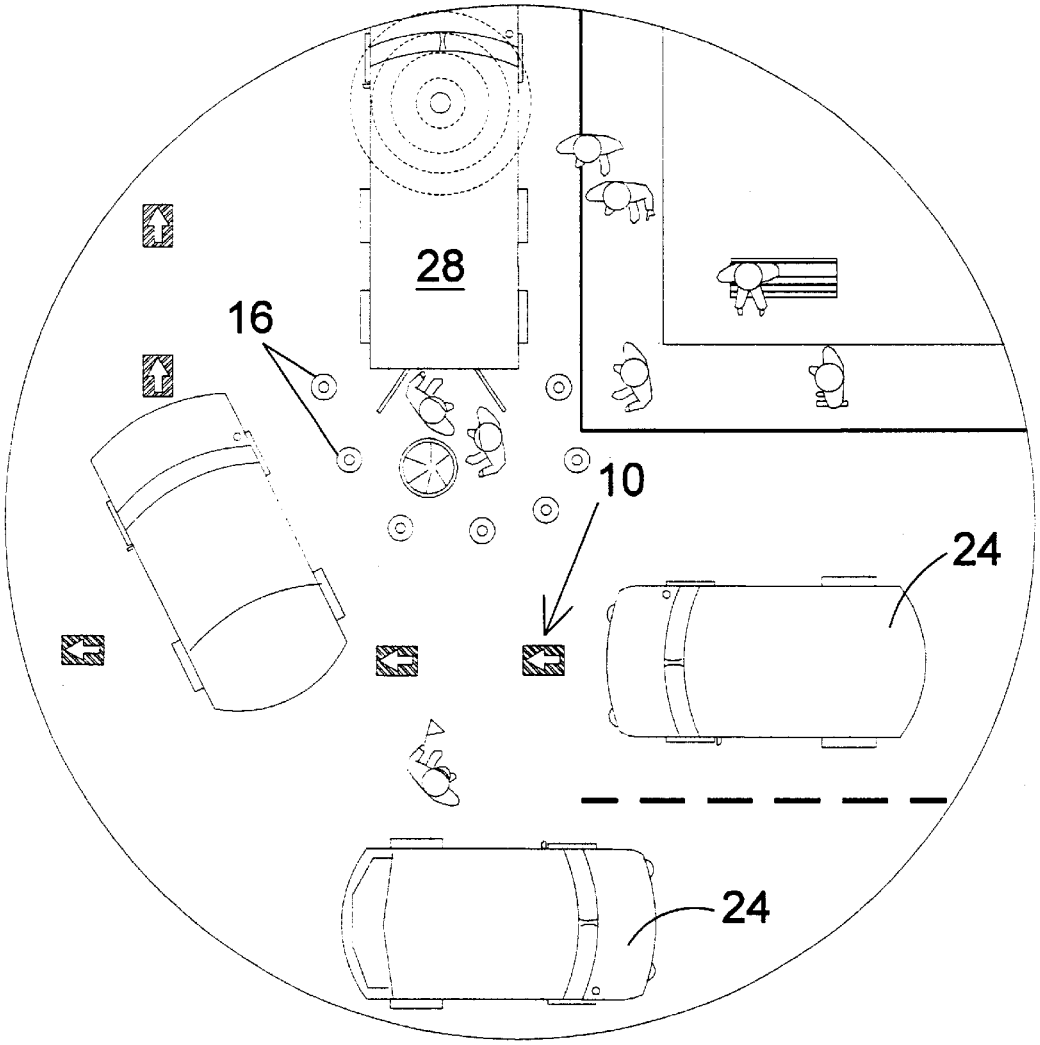
FIG. 8 is a pictorial view depicting a road work traffic diversion exercising the use of the traffic directional mat in conjunction with other traffic safety devices. The illustration shows the present invention clearly indicating the correct path for redirection of traffic.

Turning to FIG. 8, shown therein is a pictorial view depicting a road work traffic diversion using cones 16 exercising the use of the traffic directional mat 10 in conjunction with other traffic safety devices and emergency vehicle 28. The illustration shows the present invention 10 clearly indicating the correct path for redirection of vehicles 24 comprising the traffic.

Figure 9:
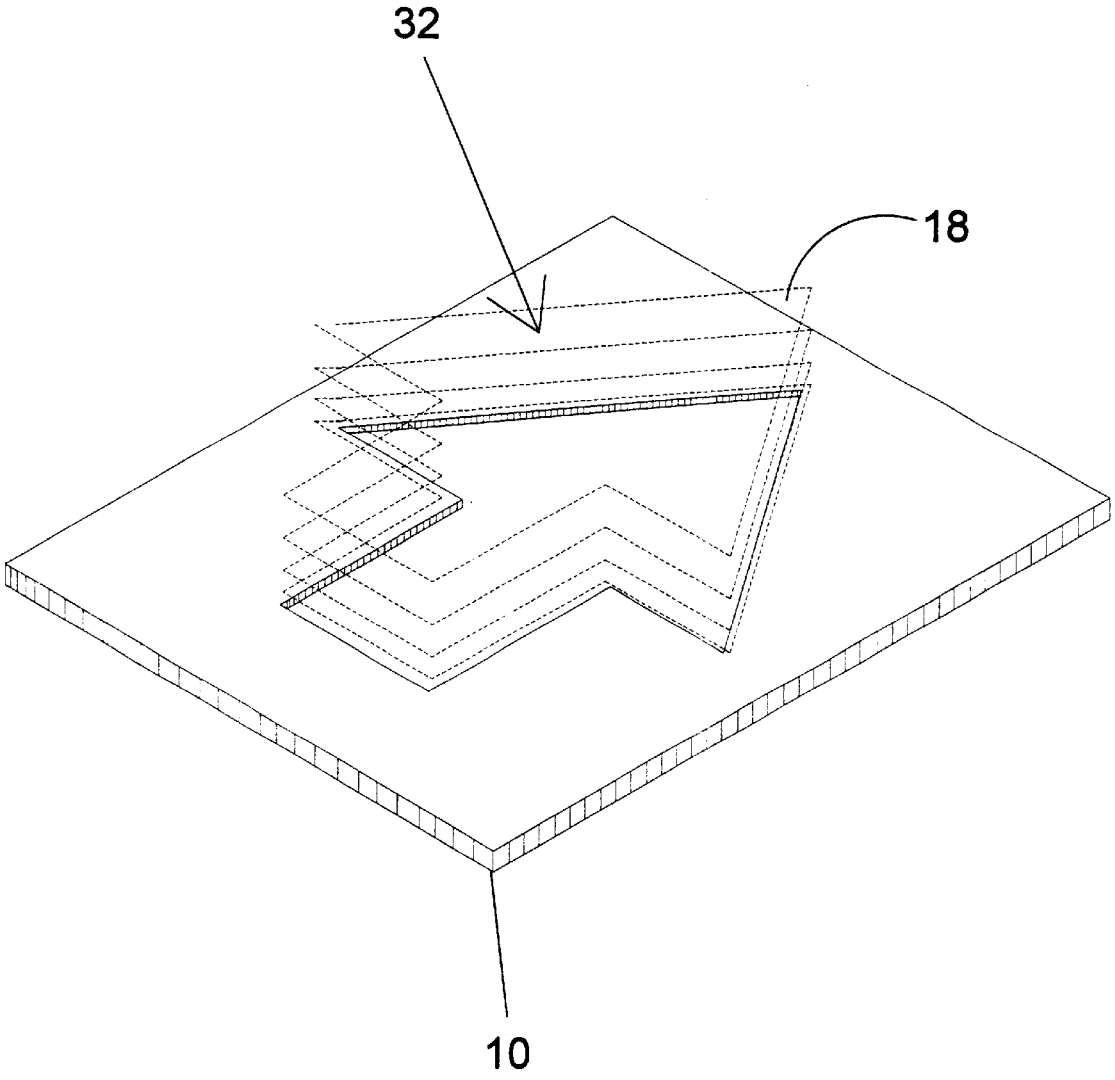
FIG. 9 is a perspective view of the present invention depicting the reflective qualities of the directional arrow and proportion of the arrow in relation to the mat itself. The indented arrow may be repainted as required with reflective paint.

Turning to FIG. 9, shown therein is a perspective view of the present invention 10 depicting the reflective white paint qualities 32 of the directional arrow 18 and proportion of the arrow in relation to the mat itself. The indented arrow 18 may be repainted as required with reflective paint. Arrow 18 may also be painted with phosphorescent paint.

Figure 10:
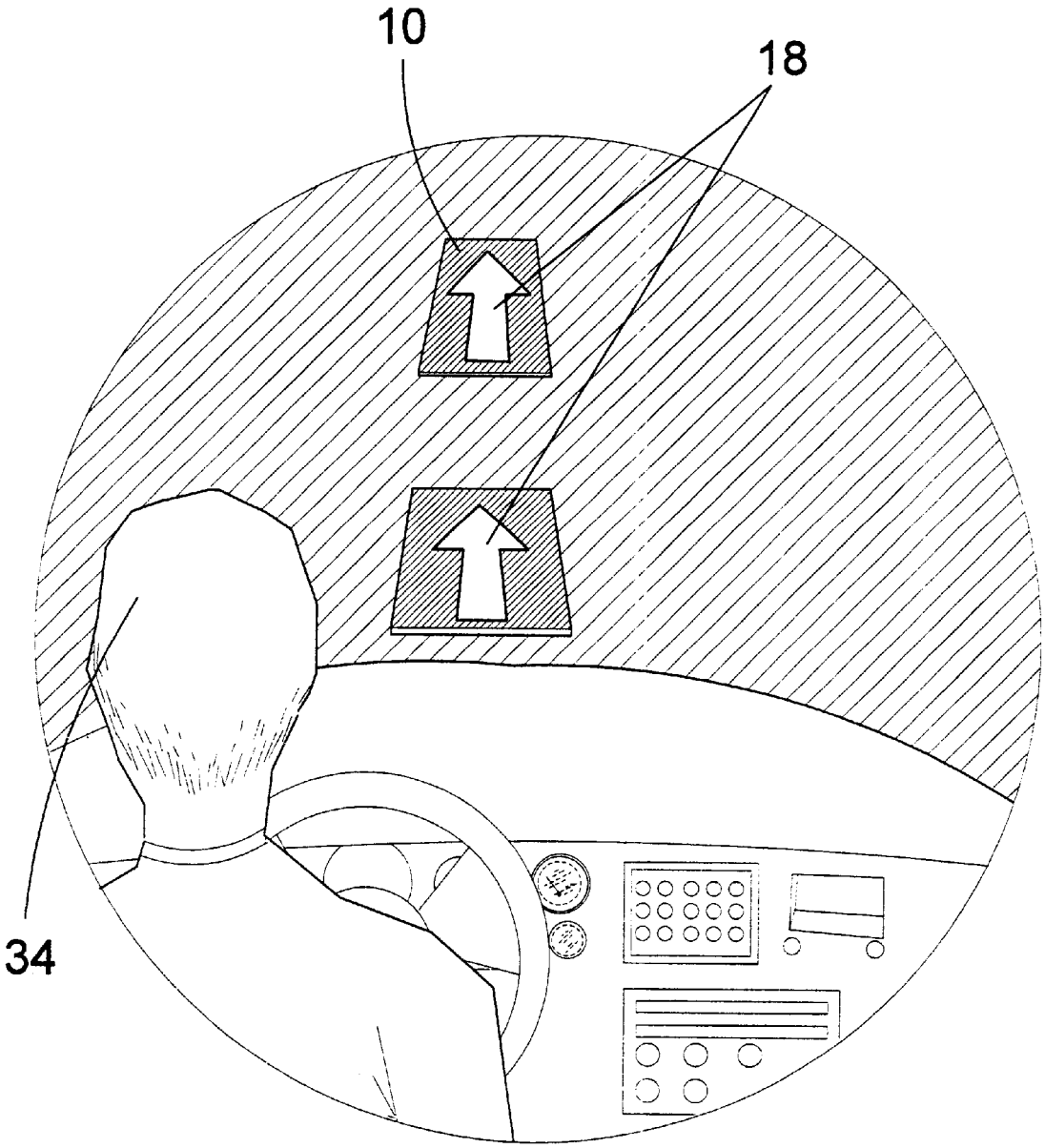
FIG. 10 is a pictorial view of the present invention depicting a motorist interacting and responding to the traffic directional mat in which clearly indicates the correct path for the redirection of traffic.

Turning to FIG. 10, shown therein is a pictorial view of the present invention 10 depicting a motorist 34 interacting and responding to the traffic directional mat 10 which clearly indicates with reflective indented directional arrow 18 the correct path for the redirection of traffic.

Figure 11:
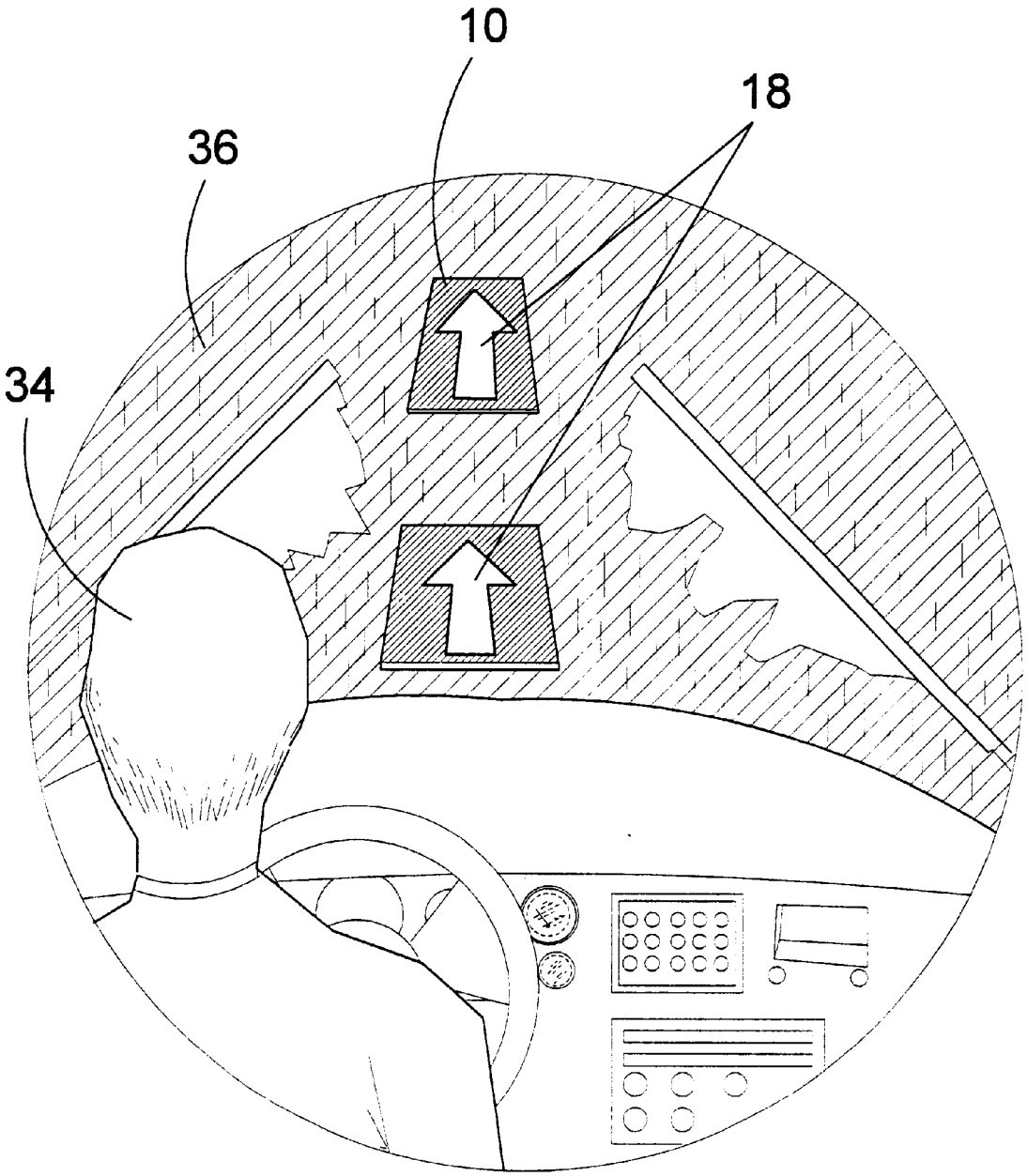
FIG. 11 is a pictorial view depicting a motorist interacting in poor weather conditions to the clearly indicated traffic directional mats. The correct path of traffic flow is visible in less than perfect ambient light conditions as well as to the nature of the device itself which presents an easily noticeable indication of travel direction.

Turning to FIG. 11, shown therein is a pictorial view depicting a motorist 34 interacting in poor weather conditions; i.e., rain 36, to the clearly indicated traffic directional mats 10. The correct path of traffic flow is visible in less than perfect ambient light conditions as well as the nature of the device itself which presents an easily noticeable indication of travel direction using reflective indented directional arrow 18.

What is claimed to be new and desired to be protected by Letters Patent is set forth in the appended claims.

I claim:

1. The method of re-directing traffic comprising the steps of:

a) storing and stacking a plurality of traffic directional mats in a trunk of a police vehicle so as to be readily available for use, each of said traffic directional mats consisting of a rectangular planar member about 4' by 5' in size, and made of rubber with a thickness of substantially between ½" and ¾", each said planar member having a top side and bottom side, said top side of said planar member containing an indented arrow of reflective material so as to ensure easy visibility for motorists;

b) said police vehicle responding to a traffic obstruction;

c) isolating the traffic obstruction;

d) removing the traffic directional mats from the police vehicle; and e) selectively placing and spacing from each other large numbers of said traffic directional mats around the obstruction to create a newly re-directed traffic pattern.

2. The method of re-directing traffic as stated in claim 1, wherein said reflective material is white.

* * * * *